United States Patent [19]

Jackson

[11] Patent Number: 4,637,331

[45] Date of Patent: Jan. 20, 1987

[54] SAIL AND SAILING RIG

[76] Inventor: Gregg B. Jackson, 721 Upshur St., NW., Washington, D.C. 20011

[21] Appl. No.: 675,610

[22] Filed: Nov. 28, 1984

[51] Int. Cl.[4] ..... B63H 9/08

[52] U.S. Cl. ..... 114/39; 114/103

[58] Field of Search ..... 114/102, 103, 39, 104, 114/108

[56] References Cited

U.S. PATENT DOCUMENTS

| | | | |
|---|---|---|---|
| 2,561,253 | 7/1951 | Wells-Coates | 114/102 |
| 3,802,366 | 4/1974 | Mankawich | 114/103 |
| 4,437,425 | 3/1984 | Unden | 114/102 |
| 4,487,148 | 12/1984 | Umeda | 114/106 |
| 4,593,638 | 6/1986 | Cochran et al. | 114/103 |

FOREIGN PATENT DOCUMENTS

| | | | |
|---|---|---|---|
| 1921682 | 11/1970 | Fed. Rep. of Germany | 114/102 |

*Primary Examiner*—Sherman D. Basinger
*Assistant Examiner*—Jesûs D. Sotelo

[57] ABSTRACT

A sail and sailing rig smoothes the flow of air past a conventional mast and onto the sail, thereby enhancing the power of the sail. The sail includes a sail body having a mast-enveloping portion located at its luff in the form of a sleeve or a plurality of loops that encircle and rotate about the mast, and a connected remaining portion. The sail also has a forward fairing connected to a leading surface of the mast-enveloping portion of the sail body; the forward fairing is rotatable about the mast with rotation of the mast-enveloping portion. The sailing rig includes structures for attaching the sail to the mast, and structures for pulling the sail in and easing it out. The former may include structures for facilitating rotation of the mast-enveloping portion of the sail.

22 Claims, 8 Drawing Figures

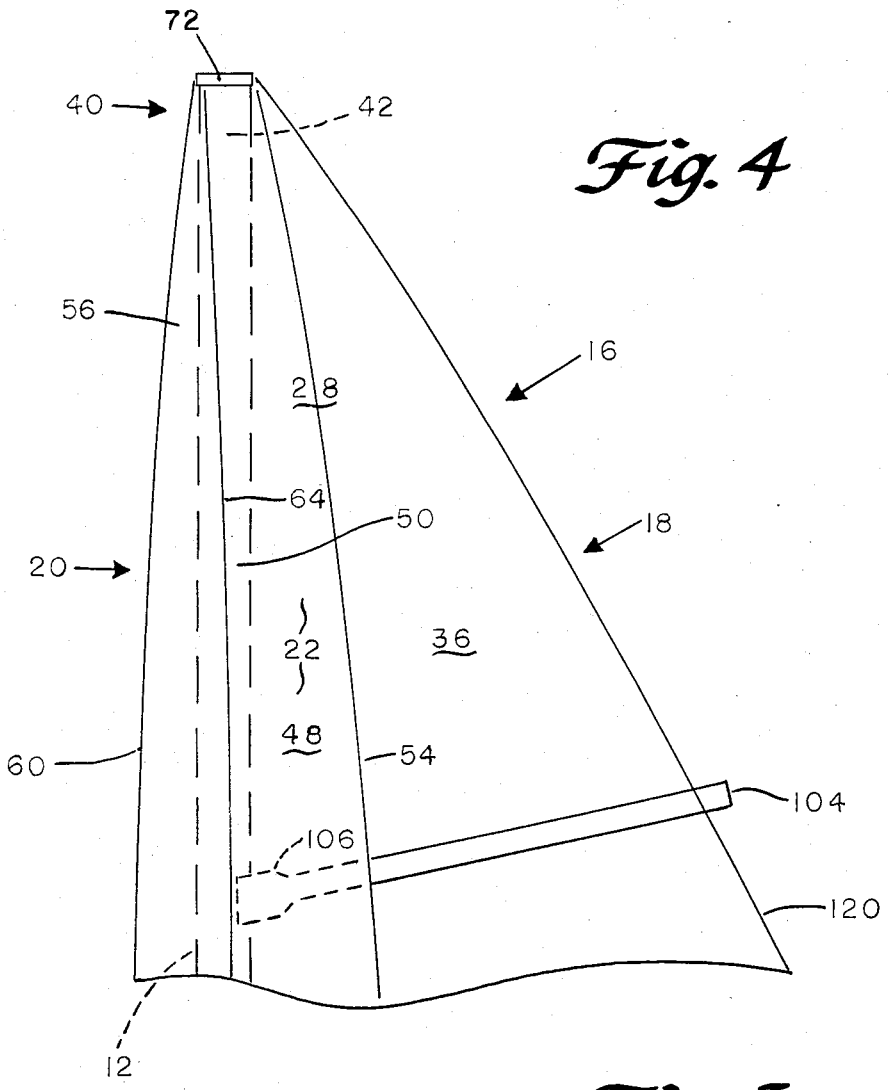
Fig. 4
Fig. 5
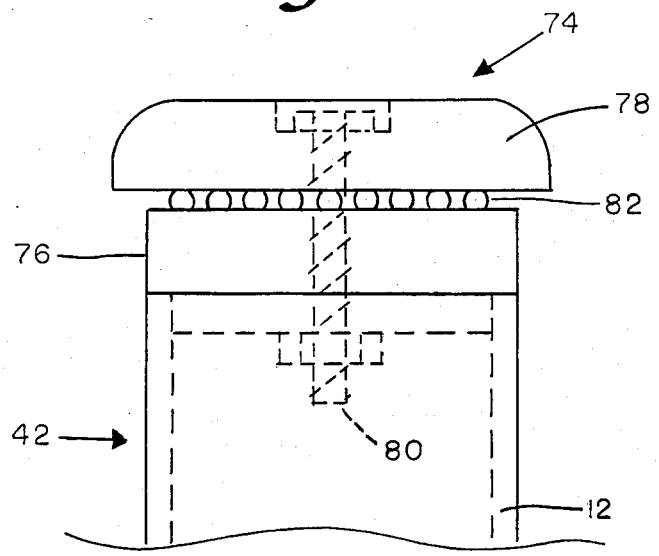

Fig. 6
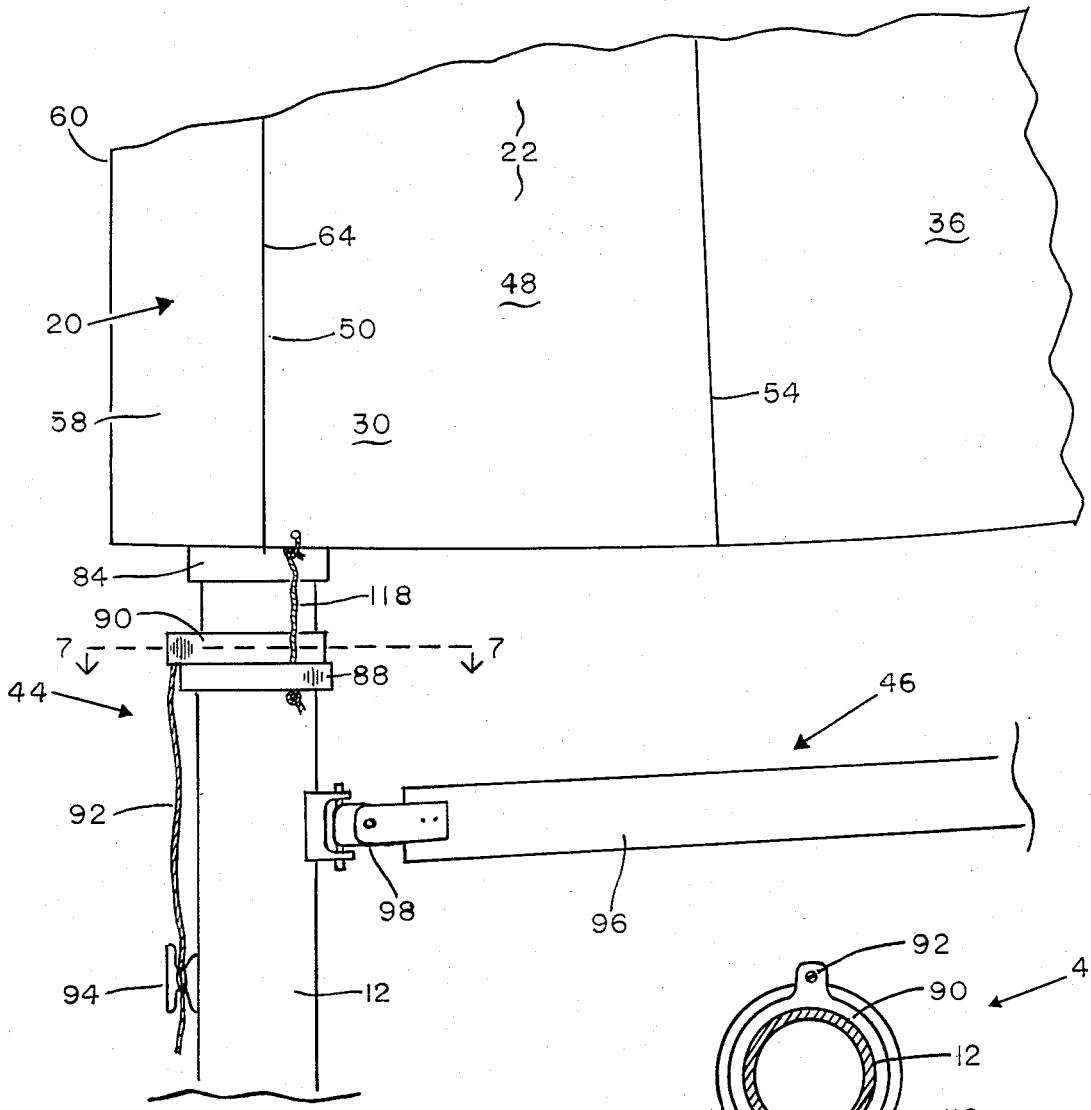
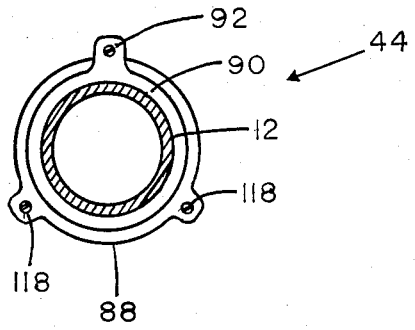
Fig. 7

SAIL AND SAILING RIG

BACKGROUND OF THE INVENTION

1. Field of the Invention

The present invention generally relates to sailing vessels and, more particularly, to an improved sail and sailing rig which incorporate features that enhance the aerodynamic functioning thereof.

2. Description of the Prior Art

Masts are a necessary evil on sailing vessels. They are costly, prone to breakage, and seriously interfere with the air flow over a sail. If they were not necessary for vertically extending sails, most designers would have done away with them years ago.

Most modern masts have a cross-sectional shape that is about circular or slightly elliptical with the major axis of the ellipse disposed parallel to the longitudinal axis of the vessel. The sail is often mounted to the mast along the transverse center of the aft side of the mast into a grooved channel or onto a track. Alternatively, on small boats the sail sometimes has a sleeve that pulls over the mast and rotates about the mast as the sail is sheeted in and out. When the sailing vessel is beating (that is, moving into the wind) or reaching (moving approximately broadside to the wind), optimum speed is achieved by sheeting in the sail so that its chord is at about a fifteen to thirty degree angle from the wind. This means that the wind must pass around the mast before flowing along the surfaces of the sail. With a conventional mast, the wind hits the relatively blunt, generally semicircular, forward surface of the mast, is deflected transversely with considerable turbulance which wastes energy, and then "reattaches" to the sail some distance behind the mast. The result is that the sail generates less power than it would with a smoother airflow past the mast.

Over the years, several different means have been used to reduce the mast's interference with airflow over the sail. As early as 1925, Francis Herreshoff disclosed a rotatable mast with a tapered leading edge and a sail composed of two layers of material. The layers at the luff of the sail were attached respectively to the opposite sides of a squared-off aft end of the mast and then extended aft separately to where they joined together at the leech of the sail. This design integrated the mast into a smooth airfoil, but it required a heavy and expensive sail as well as a moderately complex mast.

A few designers have employed a double layer sail which at its luff envelops the mast and rotates about it. This allows a relatively simple mast, but it still requires a heavy and expensive sail, and the resulting cross-sectional shape of the airfoil has a leading edge which is considerably thicker and more blunt than desirable.

Others have limited their approach to a single layer sail, but set it either on a rotatable mast which has a cross-sectional shape of a symmetrical airfoil or on a rotatable airfoil-shaped casing mounted over a conventional mast. These rigs are heavy, expensive, and sometimes require manual rotation in their use.

Still other designers have utilized articulating masts that serve in place of the forward third or half of the sail, and semirigid airfoils which envelop the mast and replace the sail. Some of these rigs have proven quite powerful, but almost all have been mechanically complex, prone to breakage, and expensive.

In summary, while significant advances in sail and mast design have occurred over the years, most have involved major tradeoffs in respect to weight, complexity, reliability, cost, and/or ease of operation.

SUMMARY OF THE INVENTION

The present invention provides an improved sail and sailing rig designed to satisfy the aforementioned needs. The improved sail increases the power of the sail on a conventional mast with little additional weight aloft, in a manner that is mechanically simple and not prone to breakage, and at a very modest expense. The improved rig involves features which facilitate optimum performance of the sail. Both the sail and sailing rig operate automatically when the vessel is under way, requiring no special attention of the crew.

The present invention is directed to an improved sail for mounting on a generally upright mast of a vessel. The sail is basically comprised of a sail body and a forward fairing. The sail body has a mast-enveloping portion generally located along the luff of the sail and a remaining portion that interconnects with the mast-enveloping portion and extends therefrom to the trailing edge of the sail body. The mast-enveloping portion may be in either of two alternative versions: a sleeve or a plurality of loops. When the sail is mounted on the mast, the sleeve or loops surround the mast and are rotatable about it.

The forward fairing is connected to the leading surface of the sleeve or the leading surfaces of the loops. As the sail is sheeted in and out, the forward fairing, the mast-enveloping portion of the sail body, and the remaining portion of the sail body all rotate about the mast, with the forward fairing always positioned on the opposite side of the mast from the remaining portion of the sail body. While beating or reaching, when the sail is sheeted in the appropriate amount, the forward fairing will point about directly into the wind, smoothing the airflow past the mast and onto the remaining portion of the sail body.

Either version of the mast-enveloping portion of the sail body is acceptable, neither one being preferred over the other. While the loop version will be somewhat less aerodynamically efficient than the sleeve version, it may also be less expensive to manufacture. In addition to improving aerodynamics, the forward fairing can easily be constructed to have positive buoyancy and thus, in the event of a capsize, will help prevent a vessel from flipping over 180 degrees.

The forward fairing extends generally from the head to the tack of the sail. It may taper aft, in a side elevation view, at its upper and lower extremities. The taper will improve the performance of the sail in those cases where the mast-enveloping portion of the sail body does not rotate as much at the head and tack as it does in between, and thus fails to angle the fairing at these locations about directly into the wind. Alternatively, friction-reducing means can be employed between the mast and sleeve at the head and tack to improve the rotation in those locations, and the taper of the forward fairing can be reduced or eliminated.

The present invention is also directed to an improved sailing rig for a vessel, which includes the combination of: (a) a mast mounted in a generally upright position on the vessel; (b) a sail having a sail body and forward fairing, with the sail body having a mast-enveloping portion and a remaining portion, and the forward fairing connected to the leading surface of the mast-enveloping portion for rotation about the mast with rotation of the mast-enveloping portion; (c) a means for supporting the head of the sail body at the top of the mast; (d) a means for vertically restraining the tack of the sail body; and (e) a means for sheeting the sail body in and out.

BRIEF DESCRIPTION OF THE DRAWINGS

FIG. 4 is an enlarged fragmentary side elevational view of the sail of FIG. 1, showing the upper portion of the sail attached to the top of the mast and having a batten extending through the sleeve and rotatably connected to the mast.

FIG. 5 is an enlarged fragmentary side elevational view of the top end of the mast of the sailing rig of FIG. 1.

FIG. 6 is an enlarged fragmentary side elevational view of the improved sailing rig, showing an alternative embodiment of the means for vertically restraining the tack of the sail.

FIG. 7 is a cross-sectional view taken along line 7—7 of FIG. 6.

DETAILED DESCRIPTION OF THE INVENTION

In the following description, references to "forward," "leading," "aft," and the like are made with the presumption that the sail and sailing rig are disposed in a normal operating position when beating with the foot of the sail about parallel to the longitudinal axis of the sailing vessel. Similarly, references to "vertical," "horizontal," "top," "down," and the like are made on the assumption that the mast of the sailing rig is disposed vertically in its upright position for normal operation. A "mast" shall include other spars to which the leading edge of a sail is attached, such as in a lateen rig.

Figure 1:
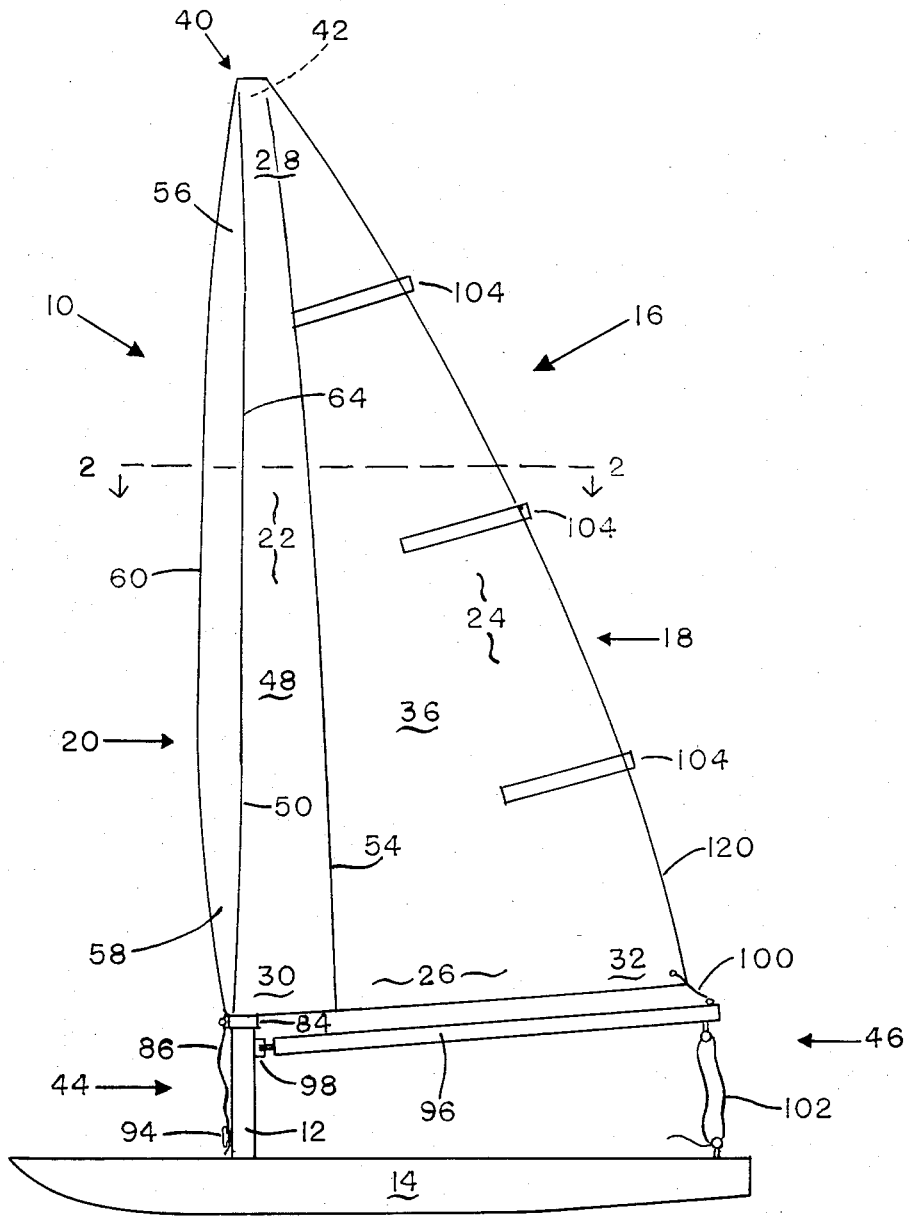
FIG. 1 is a side elevational view of a vessel mounting the sail and sailing rig of the present invention, with the sail incorporating the sleeve version of the mast-enveloping portion of the sail body.
Figure 2:
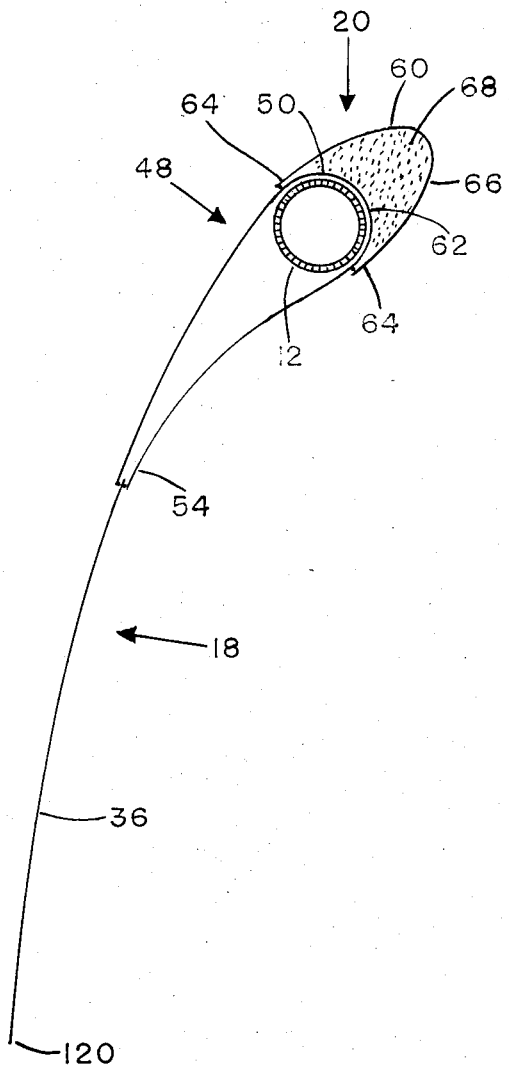
FIG. 2 is an enlarged cross-sectional view of the improved sail taken along line 2—2 of FIG. 1, showing its sleeve enveloping the mast and its forward fairing connected to the leading surface of the sleeve forward of the mast.

Referring now to the drawings, and more particularly to FIG. 1, there is shown an exemplary embodiment of the sailing rig of the present invention, generally designated 10, which includes a mast 12 of conventional design mounted in a generally upright position on a vessel 14 and an improved sail, generally indicated 16, mounted to the mast 12. The sail 16 is comprised of a sail body 18 and a forward fairing 20. Certain regions of the sail body 18 can be identified by the traditional names used to label sails. Thus, the sail body 18 has at least three sides designated the luff 22, leech 24, and foot 26; and at least three corners designated the head 28, tack 30, and clew 32. The sail body 18 includes a mast-enveloping portion, in this case a sleeve 48, located generally along the luff 22 of the sail body 18 and a remaining portion 36 interconnected with the mast-enveloping portion and extending therefrom to the trailing edge 120 of the sail body 18. As shown in FIG. 2, the mast-enveloping portion surrounds the mast 12, is rotatable about it, has a leading surface, in this case the forward section 50 of the sleeve 48, disposed and facing forwardly of it, and has an aft edge 54 interconnected with the remaining portion 36 of the sail body 18. Unlike sails heretofore, this improved sail has a forward fairing 20 connected to the forward section 50 of the sleeve 48 for rotation about the mast 12 with rotation of the sleeve 48.

In addition, the sailing rig 10 includes components for attaching and restraining the sail 16 to the mast 12 and for operating the sail. A first group of components, generally designated 40, interconnect the mast 12 and the sail body 18 for supporting the sail body proximate its head 28 on a top end 42 of the mast 12. A second group of components, generally indicated at 44, interconnect the mast 12 and the sail body 18 for vertically restraining the sail body proximate its tack 30. Finally, a third group of components, generally identified as 46, are mounted between the vessel 14 and clew 32 of the sail 16 and are operable for pulling in and easing out the sail body 18.

The sleeve 48 extends vertically approximately the full length of the luff 22 of the sail body 18 and extends aft of the mast 12 a distance equal to about three diameters of the mast over most of the sleeve's length. However, as seen in FIGS. 1 and 4, along approximately the upper fourth of the sleeve 48 the aft edge 54 tapers in a forward direction, reaching the aft edge of the mast 12 at the top end 42 thereof. The sleeve 48 and the remaining portion 36 of the sail body 18 can be constructed of thin flexible material suitable for making sails, such as "DACRON" fabric or thin "MYLAR" sheeting. The aft edge 54 of the sleeve 48 is permanently affixed to the remaining portion 36 of the sail body 18 by a suitable adhesive or by stitching. To summarize, it is apparent that the sleeve 48, as just described, essentially constitutes the luff 22 of the sail body 18.

Figure 3:
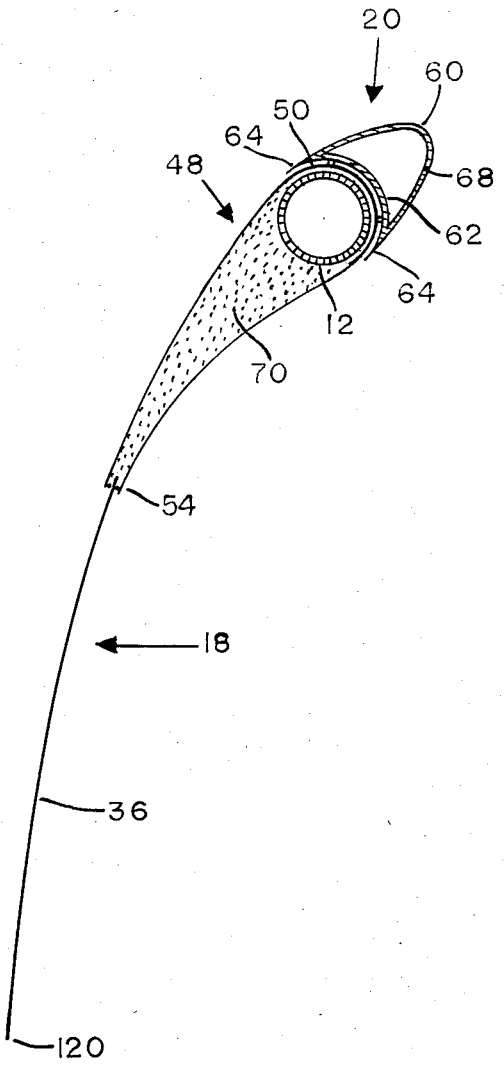
FIG. 3 is an enlarged cross-sectional view of the improved sail similar to that of FIG. 2, but with a different forward fairing and having a fill material within the aft part of the sleeve.

The forward fairing 20 of the sail 16 extends vertically approximately the full length of the sleeve 48 on the forward side of the mast 12. Over most of its length, the fairing 20 protrudes forward of the mast 12 a distance equal to about one diameter of the mast. However, as seen in FIG. 1, at upper and lower portions 56,58, the forward fairing 20 tapers in an aft direction toward the mast 12. As depicted in FIGS. 2 and 3, in cross section the forward fairing 20 has an exterior surface 60 of generally parabolic shape and an interior surface 62 of generally semicircular shape in conformity with the cross-sectional shape of the mast 12. In the case of FIG. 2, the interior surface 60 is comprised of the forward section 50 of the sleeve 48. The exterior and interior surfaces 60,62 of the forward fairing 20 merge together at aft edges 64 of the forward fairing 20 tangentially to each other and to the mast 12 at approximately the location of maximum thickness of the mast 12. As seen in FIGS. 2 and 3, the forward fairing 20 and sleeve 48 together comprise an airfoil about the mast 12, which in cross section has a thickness close to the diameter of the mast, and a chord length equal to about five diameters of the mast.

In one exemplary embodiment, shown in FIG. 2, the forward fairing 20 is thin flexible material in the form of a pocket 66 connected to the forward section 50 of the sleeve 48 and filled with a lightweight fill material 68 such as foam or a hollow plastic molding. The shape of the sail 16, as in the case of any sail, must normally be modified somewhat for different wind and sea conditions by tensioning and thus stretching the luff 22 of the sail body 18. And in operation, the forward fairing 20 must flex fore and aft and laterally to conform to the mast bend. Consequently, the fill material 68 of the forward fairing 20 should be stretchable at least one-eighth of an inch per foot of length under ten pounds of tension, as would be the case with moderate resiliency foams. Alternatively, the fill material 68 can be smooth enough that the pocket 66 of the fairing 20 can easily stretch and contract about it longitudinally and flexible enough to conform easily to the mast bend, as would be the case with most smooth, hollow, thin-walled plastic moldings. Though a parabolic cross-sectional shape will usually be nearly optimal for the forward fairing 20, it can have other cross-sectional shapes that smooth the airflow past the mast 12 including an elliptical shape with the major axis parallel to the chord of the sail body, and a triangular shape. Furthermore, the fill material 68 of the forward fairing 20 can impart the desired shape to the pocket 66 without entirely filling the aftmost part of the pocket 66 on each side of the mast 12, as is shown in FIG. 2, and this will facilitate insertion and removal of the fill material 68.

Other constructions of the airfoil formed by the forward fairing 20 and sleeve 48 are possible within the scope of the present invention. For example, the sleeve 48 can be constructed with two sections, one fitting snugly about the mast 12 and one constituting the tail of the airfoil. The fill material 68 alone can constitute the forward fairing 20, as shown in FIG. 3, and be mounted outside the forward section 50 of the sleeve 48 by means such as ties, "VELCRO" patches, or snaps, instead of a pocket. The fill material can be removably affixed to the inside of the forward section 50 of the sleeve 48, bearing against the mast 12. In another option, also shown in FIG. 3, the volume within the sleeve 48 aft of the mast 12 is filled with an aft fill material 70, which again is a lightweight material such as foam or a plastic molding. As with the fill material 68 of the forward fairing 20, the aft fill material 70 should have modest flex and allow some stretching of the sleeve when the luff 20 is tensioned.

The sail 16 of the present invention has a natural tendency not to rotate as freely at the head 28 and tack 30 of the sail body 18 as in the middle thereof along the luff 22. If the forward fairing 20 does not rotate about directly into the wind, the sail 16 will probably perform better with little or no forward fairing 20. For this reason, the forward fairing 20 tapers aft at its upper and lower portions 56,58, as previously mentioned. However, there are measures which can be taken to facilitate rotation of the mast-enveloping portion in these areas and some may allow the effective use of a forward fairing 20 that does not taper at its upper and lower portions 56,58. For example, in small sails subject to little tension along the luff 22, leech 24 and foot 26 thereof, the differential rotation along the forward fairing 20 can be reduced with the use of a simple low friction means 84, between the mast 12 and the mast-enveloping portion at the tack 30 as shown in FIG. 1, and/or at the head. Such means can include "TEFLON" and silicone coatings, and nylon bushings.

Rotation near the tack 30 can be additionally facilitated by vertically restraining the sail 16 at the tack 30 with a long cunningham 86 that is free to move to either side of the mast 12 with rotation of the sail body 18. Such a cunningham is shown in FIG. 1. The long cunningham 86 leads down the front side of the mast 12 so that the gooseneck 98 will not prevent its movement to the side. The cunningham is secured to a cleat 94 as far below the tack 30 as is convenient. The longer the run of the cunningham, the more the rotation of the sail 16 will be facilitated.

In sails subject to moderate tension along the luff 22, leech 24 and foot 26 thereof, as is common with sailboard sails and boat sails of about seventy to one hundred fifty square feet, rotation about the mast 12 can be facilitated by the following. The first group of components 40, briefly mentioned earlier, hold the sail body 18 at its head 28 on the top end 42 of the mast 12, but they do so allowing rotation of the mast-enveloping portion of the sail body 18 about the mast with minimal friction. In one exemplary embodiment, this first group of components 40 includes a seal 72 at the very top of the sleeve 48, as shown in FIG. 4, and a rotatable means, generally designated 74 in FIG. 5, mounted on the top end 42 of the mast 12. The rotatable means 74 in this case include an end plug 76 fitted into and attached to the top end 42 of the mast 12, and a rotor 78 placed above the end plug 76 and rotatably coupled to it with a bolt 80. The rotor 78 is about one-half to one inch larger in diameter than the mast's outside diameter. Ball bearings 82 between the end plug 76 and the rotor 78 minimize friction between the two. Additionally, needle bearings can be placed between the bolt 80 and the rotor 78. The seal 72 which bears on the rotor 78 of the rotatable means 74 can be stitching perpendicular to the longitudinal axis of the sleeve 48 which closes it off, or can be a round piece of fabric with a diameter an inch or so larger than that of the mast 12 being affixed orthogonally to the sleeve 48 so as to close it off. Alternatively, the seal 72 can be replaced with an inverted cup at the top of the mast-enveloping portion of the sail body 18. The cup would fit over the rotor 78.

The second group of components 44, briefly referred to earlier, for vertically restraining the sail body 18 proximate its tack 30, is shown in FIGS. 6 and 7. The second group 44 includes a low friction means 84 between the mast 12 and the mast-enveloping portion, in this case a sleeve 48, at the tack 30 of the sail body 18, such as a "TEFLON" coating or nylon bushing on the mast 12, a short cunningham 118 on each side of the mast-enveloping portion aft of where the mast-enveloping portion bears against the mast 12, a low friction collar 88 slidably and rotatably mounted about the mast 12, and a restraining collar 90 located above the low friction collar 88 and also slidable along the mast. The short cunninghams 118 are led directly down and attached to the low friction collar 88, while the latter is restrained from upward movement by the restraining collar 90. The restraining collar 90 is vertically adjustable by means of a vertical control line 92 secured to and extending between the front of the collar 90 and a cleat 94 mounted on the front of the mast 12. The low friction collar 88 must rotate with little friction when bearing against the restraining collar 90 with moderate force. It can be made of an inherently low friction material such as nylon or have some means between it and the restraining collar 90, such as ball bearings, to minimize the friction.

In FIG. 6 the two collars are positioned on the mast 12 above the gooseneck 98, allowing about one hundred twenty degrees of rotation for the low friction collar 88 and the short cunninghams 118. If that position is not convenient, the collars can be positioned below the gooseneck 98, and will then permit about fifty-five degrees of rotation in either direction.

The third group of components 46, previously referred to briefly, is for pulling in and easing out the sail body 18. One exemplary embodiment is shown in FIG. 1. It includes a boom 96 pivotally mounted at its inner end by a gooseneck 98 to the mast 12 on the aft side thereof at a location spaced below the tack 30 of the sail body 18. The boom 96 is connected at its outer or distal end to the clew 32 of the sail body 18 by an outhaul 100 and to the sailing vessel 14 by a sheetline 102.

Also, as depicted in FIGS. 1 and 4, the improved sail 16 has a plurality of battens 104 disposed in a generally forward and aft direction along the remaining portion 36 of the sail body 18 proximate the leech thereof and in spaced relation between the head 28 and clew 32 thereof. At least the top batten 104 is "full length." The full length batten 104, seen in FIG. 4, projects between the two layers of the sleeve 48 and is connected to a means for engaging and rotating about the mast 12, such as a yoke 106.

Figure 8:
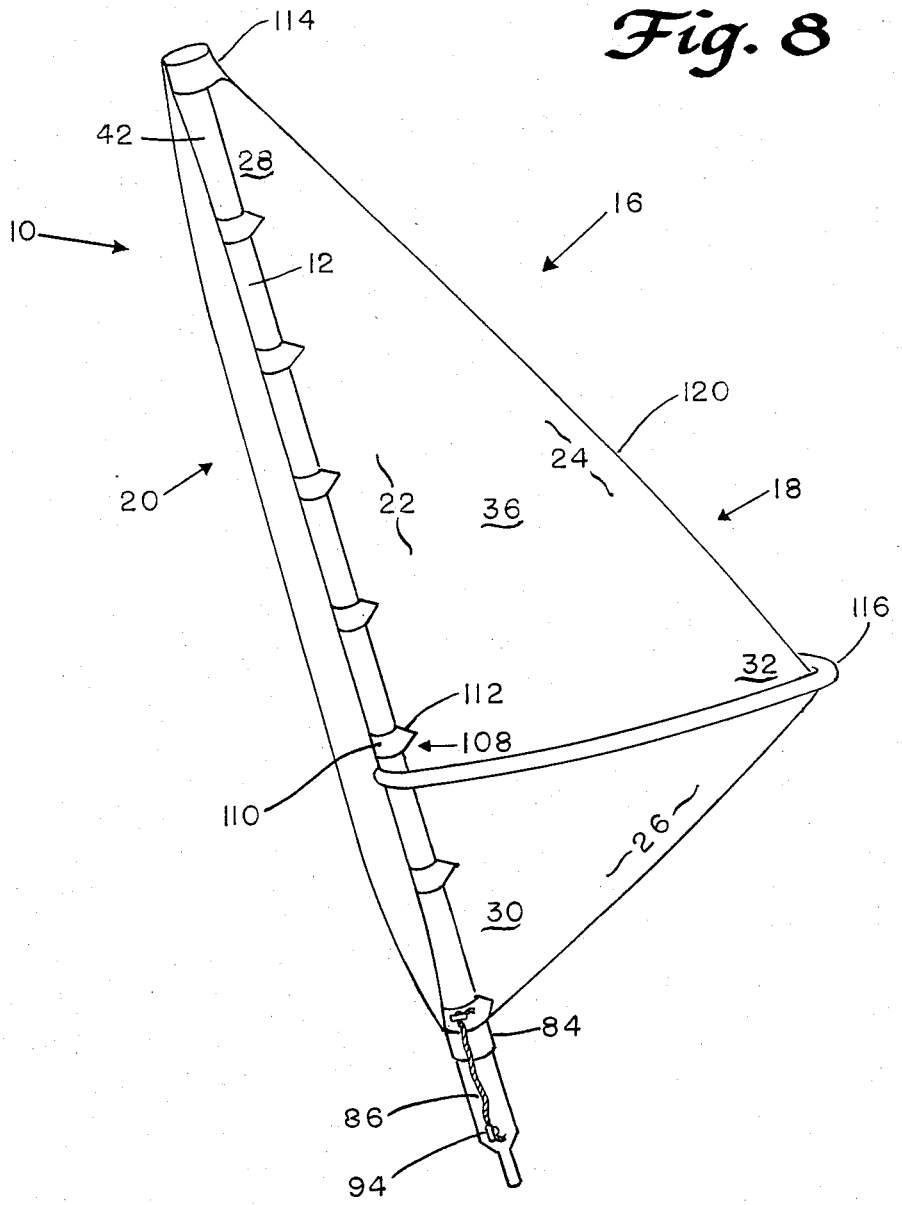
FIG. 8 is a perspective view of the sail and sailing rig of the present invention, with the sail incorporating the loop version of the mast-enveloping portion of the sail body and employing a different boom arrangement than that seen in FIG. 1.

Another version of the mast-enveloping portion of the sail body 18 is illustrated in FIG. 8. Here, the sail body 18 has a single layer luff 22 mounted on the mast 12 by a plurality of loops 108 spaced apart and located along the luff. The loops 108 envelop the mast 12 and are rotatable about it, and have respective forward segments 110 which define the leading surface of the mast-enveloping portion of the sail body 18. Also, the respective loops 108 include rearward segments 112 which extend aft from the forward segments 110 and interconnect with the remaining portion 36 of the sail body 18. The forward fairing 20 is connected to the forward segments 110 of the loops 108 and is rotatable about the mast 12 with rotation of the loops. The sail body 18 is attached and restrained much as discussed hereabove. For instance, the head 28 of the sail body 18 can be held to the top end 42 of the mast 12 by an inverted cup 114 that is connected to the mast-enveloping portion of the sail body 18 and fits over the top of a rotating means on the mast 12. Means for vertically restraining the tack 30 of the sail body 18 is a low friction means 84 and a long cunningham 86 like the one shown in FIG. 1. The sail 16 is pulled in and eased out with a different kind of boom, a wishbone boom 116 that is handheld by the sailor.

The operation of the sail 16 and sailing rig 10 of the present invention is, from the sailor's point of view, virtually identical to that of conventional sails and sailing rigs. The sail body 18 is pulled in and eased out for different headings of the vessel 14. The optimal angle of attack with the wind is usually judged by observing the luff 22 area of the sail body 18, by observing telltales on the sail, and by the "feel" of the vessel 14. As the sail body 18 is pulled in and eased out, the sleeve 48 or loops 108 and the forward fairing 20 automatically rotate about the mast 12. While beating and reaching when the sail body 18 is at its optimum angle of attack, the forward fairing 20 points about directly into the wind. The forward fairing 20 and sleeve 48, when the sleeve is used, smooth the flow of air past the mast 12 and onto the remaining portion 36 of the sail body 18, increasing the power of the sail.

The sailing vessel 14 shown in FIG. 1 is a boat with the mast 12 rigidly supported upright by a step and brace. The present invention, however, can be used on other types of vessels, such as boats with stayed masts, sailboards with the mast pivotally connected to the board, and otherwise supported by the sailor, ice boats, land sailing vehicles, and any other wind-driven craft that use sails.

It is to be understood that various changes can be made in the form, construction, and arrangement of the parts of the sail and sailing rig described hereabove without departing from the spirit and scope of the invention or sacrificing all of its material advantages, the description being merely of preferred or exemplary embodiments thereof.

I claim:

1. A sail for mounting on a mast of a wind-driven vessel, said sail comprising:

(a) a sail body having a head, tack, luff, and trailing edge, and including a mast-enveloping portion being generally located at the luff of said sail body, said mast-enveloping portion being adapted to at least partially surround and substantially rotate about the mast, and having a leading surface disposed and facing forwardly of the mast; and (b) a semirigid forward fairing connected to said leading surface of said mast-enveloping portion of said sail body so as to be disposed forwardly of the mast and define, with said mast-enveloping portion, an airfoil rotatable about the mast.

2. The sail as recited in claim 1, wherein said sail body further comprises, in addition to said mast-enveloping portion, a remaining portion interconnected with said mast-enveloping portion and extending therefrom to said trailing edge of said sail body, said mast-enveloping portion being adapted to dispose said remaining portion of said sail body aft of the mast for rotation about said mast with rotation of said mast-enveloping portion; and wherein said semirigid forward fairing is connected to said leading surface in a manner that does not substantially restrict stretching and contracting of said sail body along said luff in response to variations in tension along said luff.

3. The sail as recited in claim 2, wherein said mast-enveloping portion of said sail body is in the form of an elongated sleeve generally located at said luff of said sail body, said leading surface of said mast-enveloping portion being defined by a forward section of said sleeve, said sleeve having an aft edge, said sleeve extending from said forward section to said aft edge, and said aft edge interconnecting with said remaining portion of said sail body.

4. The sail as recited in claim 3, wherein said aft edge of said sleeve tapers in a forward direction at said head of said sail body.

5. The sail as recited in claim 3, having an aft fill material within the volume of said sleeve aft of the mast.

6. The sail as recited in claim 3, further comprising a plurality of battens, at least one of said battens being of full length and projecting forwardly within the aft part of said sleeve for rotatable connection to the mast.

7. The sail as recited in claim 1, wherein said forward fairing includes an upper portion, extending generally toward the head of said sail body, said upper portion tapering in an aft direction.

8. The sail as recited in claim 1, wherein said forward fairing includes a lower portion, extending generally toward the tack of said sail body, said lower portion tapering in an aft direction.

9. The sail as recited in claim 2, wherein said mast-enveloping portion of said sail body is in the form of a plurality of loops spaced apart and generally located along the luff of said sail body, said leading surface of said mast-enveloping portion being defined by respective forward segments of said loops, said loops including respective rearward segments which extend aft from said forward segments and interconnect with said remaining portion of said sail body.

10. In a sailing rig for a wind-driven vessel, the combination comprising:

(a) a mast mounted in a generally upright position on said vessel and having a top end;

(b) a sail body having a head, tack, luff, and trailing edge, and including a mast-enveloping portion being generally located at the luff of said sail body, said mast-enveloping portion being adapted to at least partially surround and substantially rotate about said mast and having a leading surface disposed and facing forwardly of said mast;

(c) a semirigid forward fairing connected to said leading surface for rotation about said mast with rotation of said mast-enveloping portion;

(d) a first means interconnecting said mast and said mast-enveloping portion for supporting said sail body proximate its said head on said top end of said mast;

(e) a second means interconnecting said mast and said mast-enveloping portion for vertically restraining said sail body proximate its said tack; and (f) a third means interconnecting said mast and said sail body and operable for pulling in and easing out said sail body.

11. The sailing rig as recited in claim 10, wherein said sail body further comprises, in addition to said mast-enveloping portion, a remaining portion interconnected with said mast-enveloping portion and extending therefrom to said trailing edge of said sail body, said mast-enveloping portion being adapted to dispose said remaining portion of said sail body aft of said mast for rotation about said mast with rotation of said mast-enveloping portion; and wherein said semirigid forward fairing is connected to said leading surface in a manner that does not substantially restrict stretching and contracting of said sail body along said luff in response to variations in tension along said luff.

12. The sailing rig as recited in claim 11, wherein said forward fairing includes an upper portion, extending generally toward the head of said sail body, which tapers in an aft direction.

13. The sailing rig as recited in claim 11, wherein said forward fairing includes a lower portion, extending generally toward the tack of said sail body, which tapers in an aft direction.

14. The sailing rig as recited in claim 11, further comprising a means interconnecting said mast and said mast-enveloping portion of said sail body for reducing friction produced between said mast and mast-enveloping portion upon rotation thereof about said mast.

15. The sailing rig as recited in claim 11, wherein said first means includes a rotating means mounted at said top end of said mast, and a means connected to said mast-enveloping portion of said sail body proximate the head thereof and engaged with said rotating means.

16. The sailing rig as recited in claim 11, wherein said second means includes a low friction collar about said mast below said tack of said sail body, a vertical restraining means that vertically restrains said low friction collar while allowing it to rotate about said mast, and at least one cunningham led to said low friction collar.

17. The sailing rig as recited in claim 11, wherein said mast-enveloping portion of said sail body is in the form of an elongated sleeve generally located at said luff of said sail body, said leading surface of said mast-enveloping portion being defined by a forward section of said sleeve, said sleeve having an aft edge, said sleeve extending from said forward section to said aft edge and said aft edge interconnecting with said remaining portion of said sail body, said aft edge tapering in a forward direction towards said head of said sail body.

18. The sailing rig as recited in claim 11, wherein said mast-enveloping portion of said sail body is in the form of a plurality of loops spaced apart and generally located along the luff of said sail body, said leading surface of said mast-enveloping portion being defined by respective forward segments of said loops, said loops including rearward segments which extend aft from said forward segments and interconnect with said remaining portion of said sail body.

19. In a sailing rig for a wind-driven vessel, the combination comprising:

(a) a mast mounted in a generally upright position on the vessel, said mast having a top end;

(b) a sail mounted on said mast, said sail including (i) a sail body having a head, tack, luff and trailing edge, said sail body composed of (A) a mast-enveloping portion generally located at the luff of said sail body, and (B) a remaining portion interconnected with said mast-enveloping portion and extending therefrom to the trailing edge of said sail body, (C) said mast-enveloping portion at least partially surrounding and substantially rotating about said mast, disposing said remaining portion of said sail body aft of said mast for rotation about said mast with rotation of said mast-enveloping portion, and having a leading surface disposed and facing forwardly of said mast, and (ii) a semirigid forward fairing connected to said leading surface of said mast-enveloping portion of said sail body so as to be disposed forwardly of said mast on an opposite side thereof from said remaining portion of said sail body and to form an airfoil with said mast-enveloping portion that is rotatable about said mast;

(c) a first means including a rotatable means at said top end of said mast, for holding said head of said sail body at said top of said mast while allowing it to rotate with little friction;

(d) a second means interconnecting said mast and said mast-enveloping portion for vertically restraining said sail body proximate its said tack;

(e) a third means interconnecting said mast and said sail body and operable for pulling in and easing out said sail body.

20. The sailing rig as recited in claim 19, wherein said mast-enveloping portion of said sail body is in the form of an elongated sleeve generally located at the luff of said sail body, said leading surface of said mast-enveloping portion being defined by a forward section of said sleeve, said sleeve having an aft edge, said sleeve extending from said forward section to said aft edge, and said aft edge interconnecting with said remaining portion of said sail body, said aft edge tapering in a forward direction towards said head of said sail body.

21. The sailing rig as recited in claim 19, wherein said mast-enveloping portion of said sail body is in the form of a plurality of loops spaced apart and generally located along the luff of said sail body, said leading surface of said mast-enveloping portion being defined by respective forward segments of said loops, said loops including rearward segments which extend aft from said forward segments and interconnect with said remaining portion of said sail body.

22. The sailing rig as recited in claim 19, wherein said second means includes a low friction collar about said mast below said tack of said sail body, a vertical restraining means that vertically restrains said low friction collar while allowing it to rotate about said mast, and at least one cunningham led to said low friction collar.

* * * * *